US011684099B2

(12) United States Patent
Shaikh et al.

(10) Patent No.: US 11,684,099 B2
(45) Date of Patent: Jun. 27, 2023

(54) HEATED GLOVE HAVING FINGER PROTRUSION APERTURES

(71) Applicants: Kareem E Shaikh, Plainfield, IL (US); Frank Ragle, Aurora, IL (US)

(72) Inventors: Kareem E Shaikh, Plainfield, IL (US); Frank Ragle, Aurora, IL (US)

( * ) Notice: Subject to any disclaimer, the term of this patent is extended or adjusted under 35 U.S.C. 154(b) by 0 days.

(21) Appl. No.: 17/187,751

(22) Filed: Feb. 27, 2021

(65) Prior Publication Data

US 2021/0274867 A1 Sep. 9, 2021

Related U.S. Application Data

(60) Provisional application No. 62/984,371, filed on Mar. 3, 2020.

(51) Int. Cl.
*A41D 19/015* (2006.01)
*A41D 19/00* (2006.01)

(52) U.S. Cl.
CPC ..... *A41D 19/01535* (2013.01); *A41D 19/002* (2013.01); *A41D 19/0013* (2013.01)

(58) Field of Classification Search
CPC ..... A41D 19/01535; A41D 19/01529; A41D 19/002; A41D 19/0017; A41D 19/01594; A41D 19/01541; A61F 7/032; A61F 2007/038; A61F 2007/0233; A61F 2007/0036
See application file for complete search history.

(56) References Cited

U.S. PATENT DOCUMENTS 1,970,081 A * 8/1934 Eisendrath ..... A41D 19/01535 126/204
2,103,594 A * 12/1937 Murray ..... A41D 19/002 2/160
2,792,827 A * 5/1957 Gravin ..... A41D 19/01535 126/204
3,838,853 A * 10/1974 Fredenhagen ..... G09B 15/06 2/161.1
4,535,482 A * 8/1985 Spector ..... A41D 19/01535 2/163
4,543,671 A * 10/1985 Monk ..... A41D 19/01 2/160
4,587,672 A * 5/1986 Madnick ..... A41D 19/01535 2/160
4,639,947 A * 2/1987 Lanscioni ..... A63B 71/146 2/161.5
4,670,909 A * 6/1987 Forrester ..... A41D 19/002 2/160

(Continued)

*Primary Examiner* — Jillian K Pierorazio
(74) *Attorney, Agent, or Firm* — Donald G. Flaynik

(57) ABSTRACT

A heated glove having finger protrusion apertures includes a glove having a predetermined configuration and dimensions; a pocket secured to each upper portion of finger members of the glove; heating members removably disposed in each pocket secured to each of the upper portions of the finger members; and a glove aperture disposed in an index finger member and a thumb aperture disposed in a thumb member of the glove for allowing a thumb and an index finger of a user to protrude from the glove; whereby, the user is enabled to operate equipment or lift objects via the exposed thumb and index finger, the thumb and index finger ultimately returning inside the heated glove.

20 Claims, 8 Drawing Sheets

(56) References Cited

U.S. PATENT DOCUMENTS 4,675,914 A * 6/1987 Mitchell ..... A41D 19/01588 2/161.1
4,706,658 A * 11/1987 Cronin ..... A61F 5/10 128/DIG. 20
4,805,242 A * 2/1989 Bolton ..... A41D 19/0024 2/160
4,862,521 A * 9/1989 Mann ..... A41D 19/0027 2/160
4,911,433 A * 3/1990 Walker ..... A63B 21/065 2/161.1
5,187,814 A * 2/1993 Gold ..... A41B 11/00 2/160
5,509,143 A * 4/1996 Yates ..... A41D 19/01535 2/160
5,680,654 A * 10/1997 McClanahan, II ..... A41D 19/0017 2/163
5,898,943 A * 5/1999 Kim ..... A63B 71/146 2/161.4
6,141,801 A * 11/2000 Helenick ..... A61F 7/02 2/160
6,592,235 B1 * 7/2003 Mayo ..... G08B 5/004 2/160
7,086,093 B2 * 8/2006 Carey ..... A41D 19/01529 2/161.6
8,464,364 B2 * 6/2013 Hofeldt ..... A41D 19/01523 2/160
9,295,580 B1 * 3/2016 Deola ..... A61F 7/03
2004/0064870 A1 * 4/2004 Gold ..... A41D 19/01 2/163
2005/0155134 A1 * 7/2005 McLin ..... A41D 19/01523 2/161.6
2005/0155961 A1 * 7/2005 Gilligan ..... A41D 19/01535 219/211
2005/0183185 A1 * 8/2005 Hozack ..... A41D 19/01594 2/161.5
2007/0028353 A1 * 2/2007 Bosnakovic ..... A41D 19/01594 2/160
2007/0157921 A1 * 7/2007 Rankin ..... C09K 5/18 126/263.01
2007/0226873 A1 * 10/2007 Mattesky ..... A41D 19/0058 2/159
2007/0256677 A1 * 11/2007 Yim ..... A61F 7/034 126/263.02
2009/0229035 A1 * 9/2009 Van Hale ..... A41D 19/002 2/163
2010/0095947 A1 * 4/2010 Gellis ..... A41D 19/01535 126/263.01
2010/0192279 A1 * 8/2010 Hunsicker ..... A41D 19/0034 2/161.2
2010/0251457 A1 * 10/2010 Lattimer ..... A41D 19/002 2/160
2011/0041229 A1 * 2/2011 Niemi ..... A41D 19/01535 607/108
2011/0072552 A1 * 3/2011 Johnson ..... A41D 19/002 2/160
2011/0088138 A1 * 4/2011 Chen ..... H05B 3/342 2/160
2013/0086730 A1 * 4/2013 Wilkening ..... A41D 19/0024 2/161.1
2013/0198932 A1 * 8/2013 Pflugfelder ..... A41D 19/0017 2/160
2013/0220297 A1 * 8/2013 Sivucka ..... A61F 7/034 126/204
2014/0230127 A1 * 8/2014 Cruz ..... F24V 30/00 2/160
2014/0325739 A1 * 11/2014 Miller ..... A41D 19/0024 2/160
2015/0074868 A1 * 3/2015 Mack ..... A41D 19/001 2/161.1
2015/0082514 A1 * 3/2015 Wiseman ..... A63B 71/146 15/244.4
2015/0119200 A1 * 4/2015 Jones ..... A63B 21/4019 482/44
2015/0157065 A1 * 6/2015 Pierias ..... A01K 13/007 126/204
2015/0289575 A1 * 10/2015 Krautner ..... A41D 19/0017 2/163
2016/0120691 A1 * 5/2016 Kirwan ..... A61F 7/02 607/111
2016/0252272 A1 * 9/2016 Riddick, Sr. ..... F24V 30/00 126/263.02
2016/0287970 A1 * 10/2016 Charles ..... A41D 19/002
2018/0014969 A1 * 1/2018 Wurapa ..... A61F 7/02
2018/0228229 A1 * 8/2018 Shatzkes ..... A41D 19/01523
2022/0117778 A1 * 4/2022 Knotts ..... A61F 7/02

* cited by examiner

HEATED GLOVE HAVING FINGER PROTRUSION APERTURES

This Utility patent application is based on Provisional Patent Application No. 62/984,371, filed on Mar. 3, 2020.

BACKGROUND OF THE INVENTION

1. Field of the Invention

The present invention relates to a heated glove, and more particularly, to a heated glove having a pocket secured to each upper portion of finger members, each pocket removably receiving a heating member. The heated glove includes glove apertures disposed in an index finger member and a thumb member of the glove for allowing a thumb and an index finger of a user to protrude from the heated glove and operate equipment or grasp an object capable of being elevated via the positioning of the object between the thumb and index finger.

2. Background of the Prior Art

Heated gloves are well known and are heated via chemical or electrical components. Electrically heated gloves are relatively more expensive than chemically heated gloves, but the batteries used to heat the gloves are re-chargeable and the heating wire connected to the batteries can be disposed within the fabric and throughout the entire glove, thereby warming all portions of a hand including fingers inserted in the glove.

Although the prior art chemically heated gloves are relatively less expensive then electrically heated gloves, chemical packets inserted in glove pockets or pouches sufficiently heat only portions of a hand that engage the glove pockets containing heat generating chemical packets. Generally, prior art chemically heated gloves do not provide a sufficient number of pockets joined to finger portions of a glove to sufficiently warm all the fingers of the hand inserted in the glove; and the prior art chemically heated gloves that do provide a sufficient quantity of pockets, do not provide an efficient apparatus to replace spent chemical packets from the glove pockets with new chemical packets.

Further, prior art chemically heated gloves do not provide finger and thumb apertures that enable a person wearing the heated glove to protrude an index finger and thumb from the glove to grasp and elevate an object when the chemical packets are generating heat to warm inside portions of the glove. A need exists for a chemically heated glove that includes one or more finger and thumb apertures that enable a person wearing the heated glove to protrude one or more fingers and thumb from the heated glove to operate equipment or grasp and elevate an object; whereupon, after the person releases the equipment or object, one or more finger and thumb apertures allow the fingers and thumb to return inside the glove, and be warmed by the chemical packets continuously heating the inside of the glove.

SUMMARY OF THE INVENTION

It is an object of the present invention to overcome many of the disadvantages associated with prior art heated gloves. A principal object of the present invention is to provide a chemically heated glove having apertures that allow at least an index finger and a thumb of a hand inserted in the heated glove to protrude from the glove and grasp and object, and after disposing the object, the apertures allow the index finger and thumb to return inside the heated the glove. A feature of the heated glove is one or more glove pockets disposed upon an outer or top side of one or more finger members and a thumb member of the glove. Another feature of the heated glove is a chemical packet removably inserted into each pocket, each chemical packet ultimately generating sufficient heat to warm the internal cavity of each finger and thumb member and the finger and thumb therein. Still another feature of the heated glove is a relatively large hand pocket disposed upon a top or outer portion of the glove. The hand pocket receives a relatively large chemical packet that, when activated, warms the cavity of the hand portion of the heated glove and the palm and respective hand portions of the user. An advantage of the heated glove is that the glove pockets, chemical packets and finger and thumb apertures cooperate to heat the user's hand and allow one or more fingers and the thumb to protrude from the glove to operate equipment or grasp an object without removing the heated glove from his or her hand, thereby enabling the return of the one or more exposed fingers and thumb to the warm confines of the heated glove.

Another object of the present invention is to provide a chemically heated glove that enables spent chemical packets to be replaced by fresh chemical packets in a minimum time period. A feature of the heated glove are pouches having pouch covers removably secured to cooperating upper portions of finger members. Another feature of the heated glove is to secure a loop material to preselected upper portions of finger members. Another feature of the heated glove is to secure a hook material to preselected portions of the pouch covers. An advantage of the heated glove is that the pouch covers are relatively quickly separated from and replaced upon the upper portions of the finger members, thereby enabling spent chemical packets to be relatively quickly removed from the glove pockets and new chemical packets to be inserted into the glove pockets; whereupon, the pouch covers are quickly secured upon the finger members.

BRIEF DESCRIPTION OF THE DRAWINGS

The foregoing invention and its advantages may be readily appreciated from the following detailed description of the preferred embodiment, when read in conjunction with the accompanying drawings in which.

DESCRIPTION OF THE PREFERRED EMBODIMENT

Figure 1:
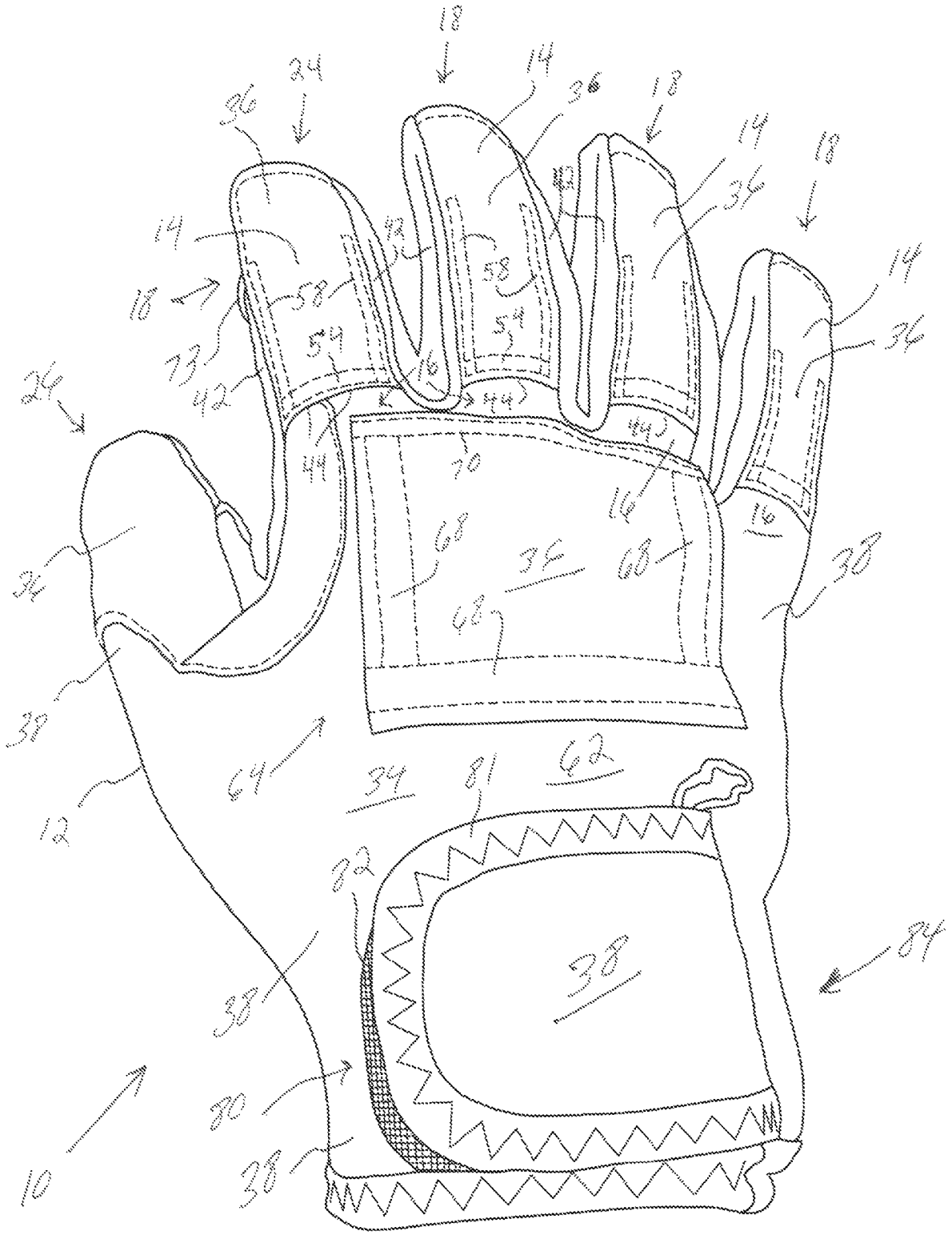
FIG. 1 is a top perspective view of a heated glove having finger protrusion apertures in accordance with the present invention.
Figure 2:
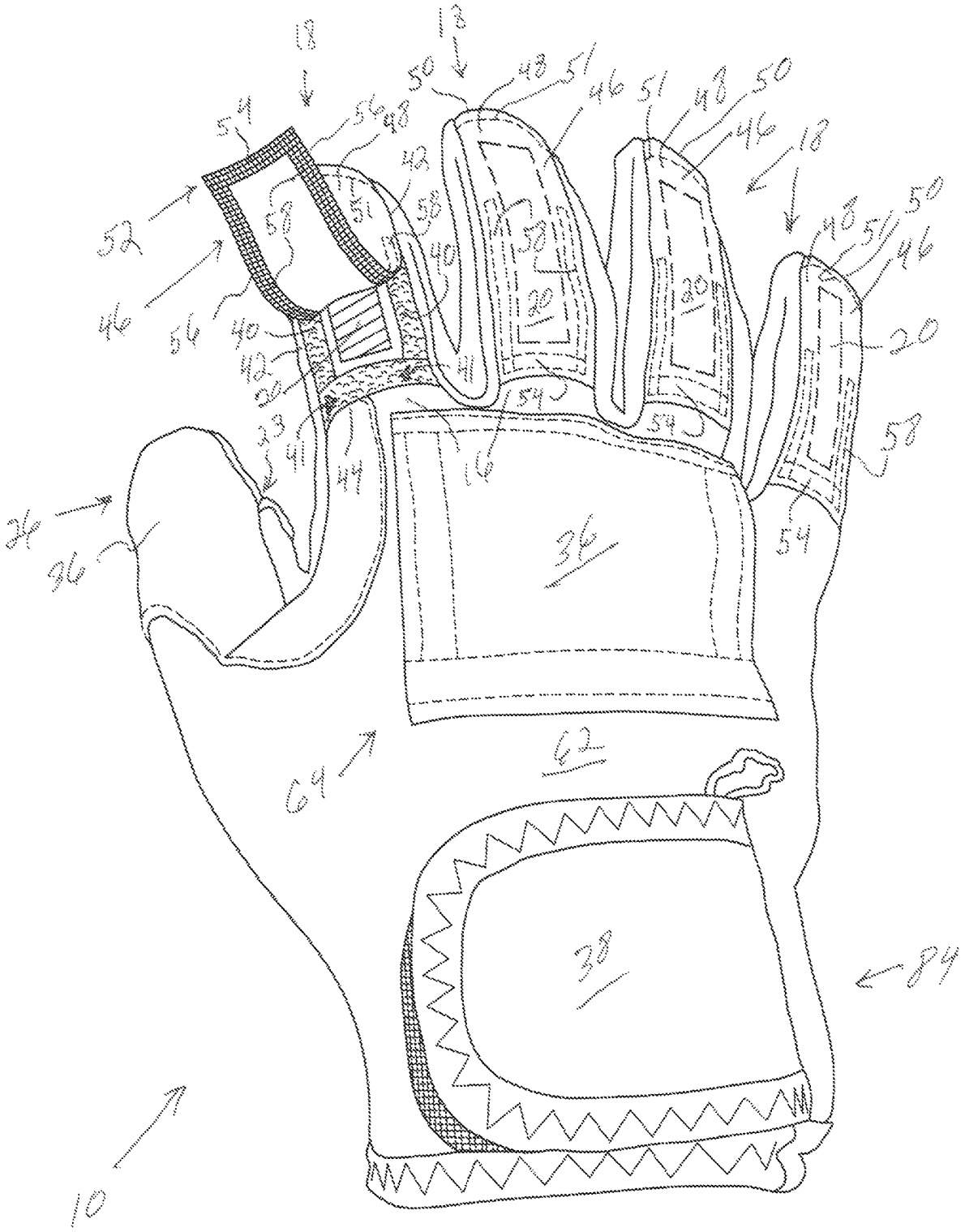
FIG. 2 is the top perspective view of FIG. 1, but with a finger cover portion separated from a finger member, thereby exposing a heating member disposed between the cover portion and an upper portion of the index finger member.
Figure 3:
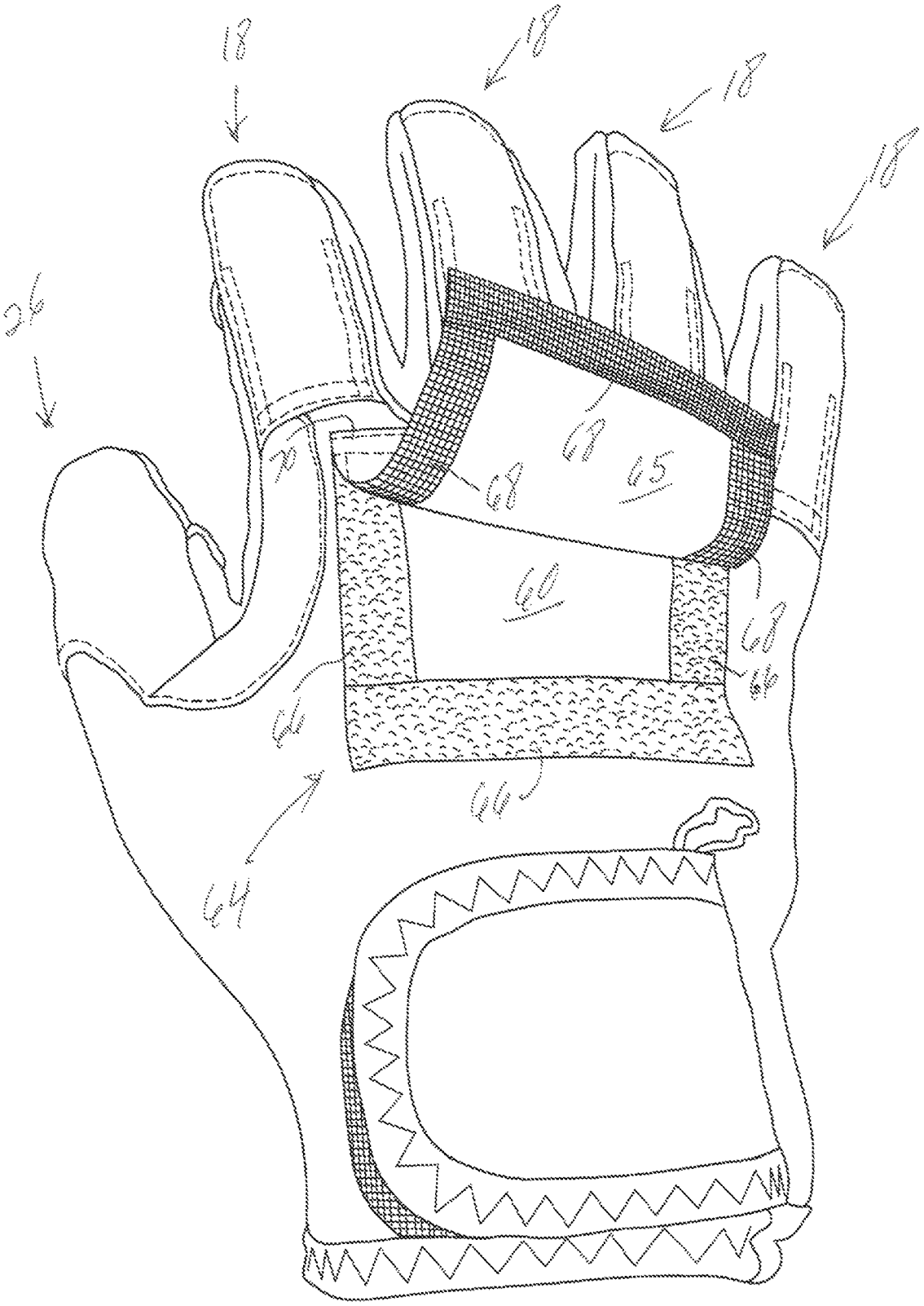
FIG. 3 is the top perspective view of FIG. 1, but with a hand cover portion of a hand pocket separated from an upper hand portion of the heated glove, thereby exposing a heating member disposed between the hand cover portion and the upper hand portion.
Figure 4:
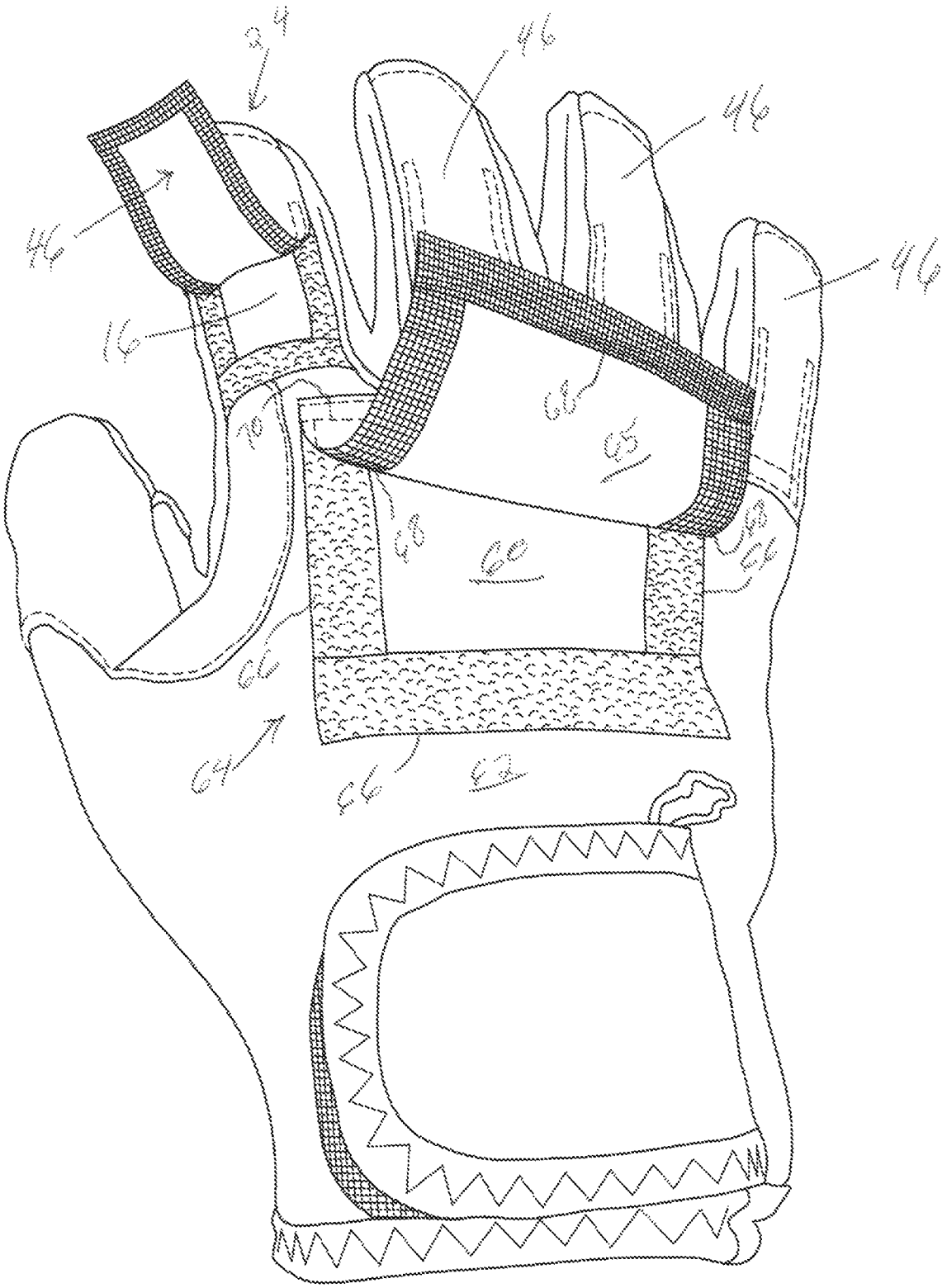
FIG. 4 is the top perspective view of FIG. 1, but with cover portions of FIGS. 1 and 2 separated from loop material, and with the heating member of FIG. 1 removed to expose the upper portion of the index finger member.
Figure 5:
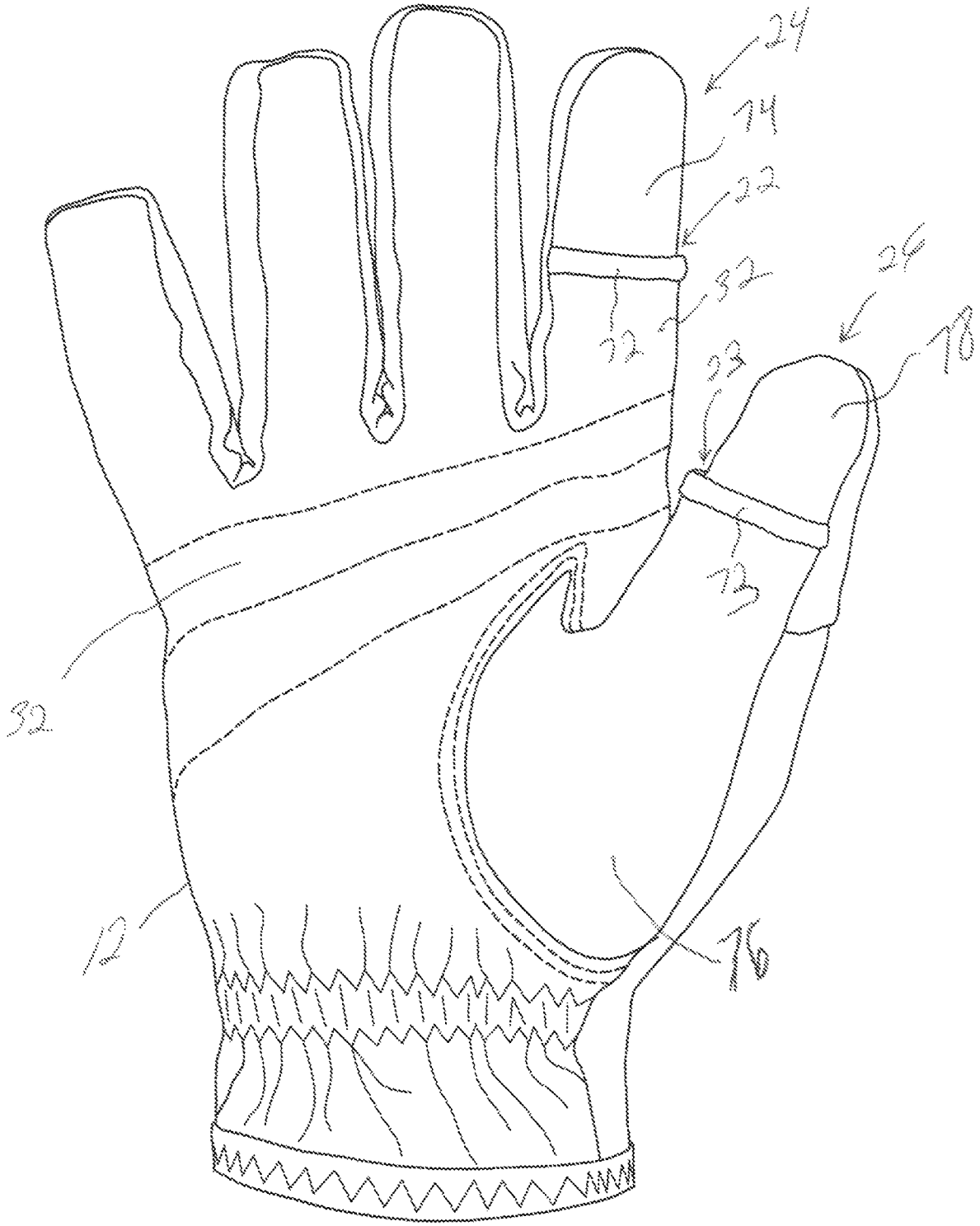
FIG. 5 is a bottom perspective view of the heated glove of FIG. 1 in accordance with the present invention.
Figure 6:
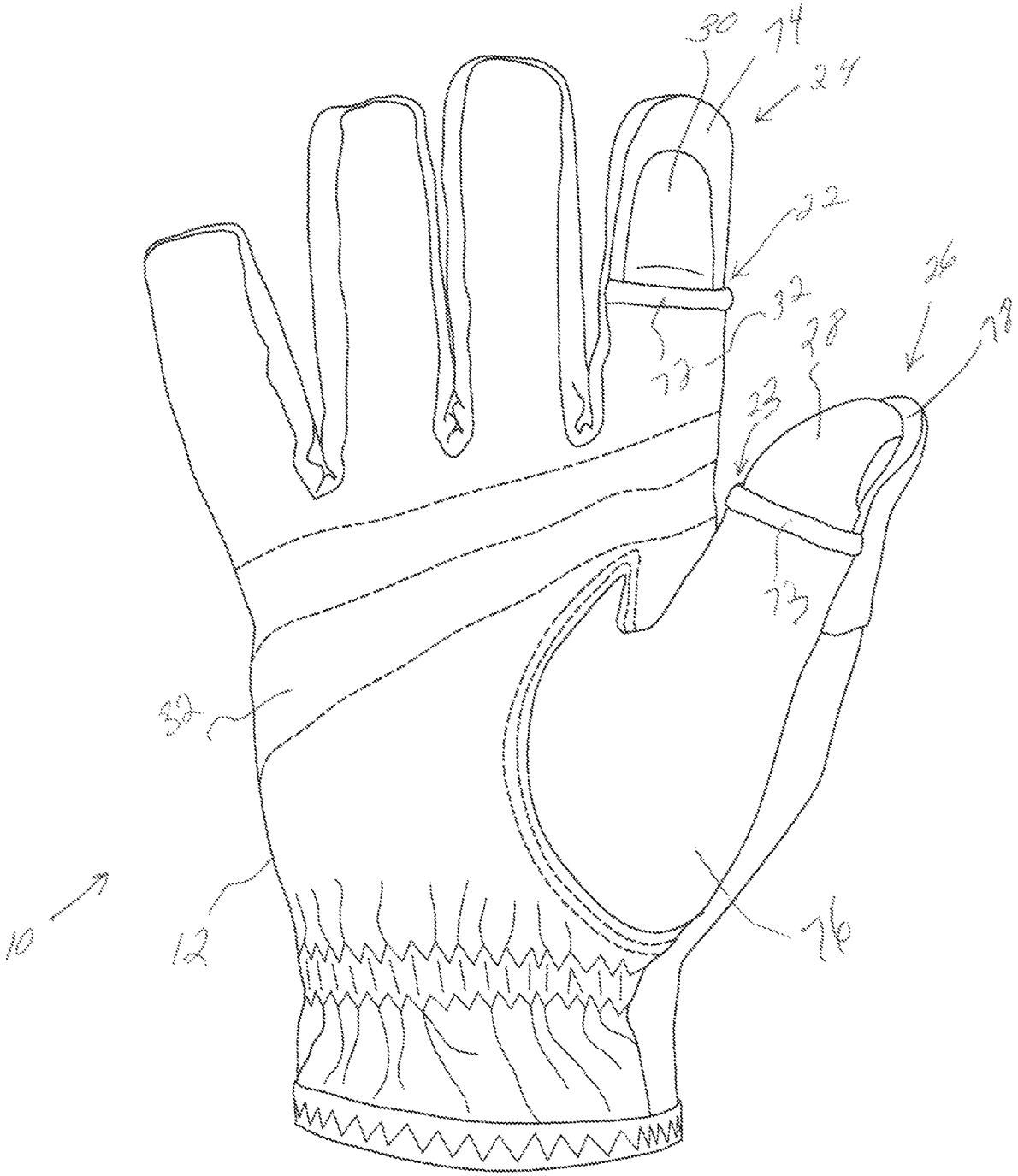
FIG. 6 is the bottom perspective view of the heated glove of FIG. 1, but with a finger and thumb depicted to illustrate aperture locations in finger and thumb members to allow a finger and thumb of a user to exit the glove in accordance with the present invention.

Referring now to drawings 1-6, a heated glove having finger protrusion apertures in accordance with the present invention is denoted as numeral 10. The heated glove 10 includes a glove member 12 having a predetermined configuration and dimensions; a pocket or pouch 14 secured to each upper or outer portion 16 of finger members 18 of the predetermined glove 12; finger heating members 20 removably disposed in each pocket or pouch 14 secured to each of the upper or outer portions 16 of the finger members 18, the finger heating members 20 each emitting a predetermined heat energy to warm an inner cavity in each finger member 18; and glove apertures 22 disposed in an index finger member 24 and a thumb aperture 23 disposed in a thumb member 26 of the glove 12 for allowing a thumb 28 and an index finger 30 of a user to protrude from the glove 12; whereby, the user is enabled to operate equipment or lift objects via the exposed thumb 28 and index finger 30 when a heated glove 10 is worn on each hand of the user.

Although the preferred glove member configuration includes multiple pockets 14 secured to one or more outer portions 16 of the finger members 18, a thumb pocket 14 (not depicted) may be secured to an outer portion of the thumb member 26 for heating the thumb, but the heating member 20 disposed in the thumb pocket 14 would reduce the articulating range of the thumb when inside the heated glove 10. A thumb pocket 14 for the thumb member would be constructed and configured the same as for the pockets 14 for the finger members 18 described infra. Further, when the heated glove 10 is designed for a specific function such as firing a shotgun, only the index finger member 18 and thumb member 26 would require respective finger and thumb apertures 22 and 23 to enable a person to fire the shotgun by manipulating the index finger 30 and thumb 28 through the respective aperture 22 and 23 to engage the trigger and gun stock portions of the shotgun.

The glove member 12 is manufactured from water proof or non-water proof materials that include but not limited to leather, latex, spandex, polyester, fleece, sheep leather, canvas, cotton, linen, rubber and combinations thereof. The preferred materials for manufacturing the glove 12 includes leather 36 forming a bottom or lower portion 32 of the glove 12, and leather 36 and polyester 38 forming a top portion 34 of the glove 12, thereby promoting the stretching of the top portion 34 of the glove 12 to allow the glove 12 to be disposed upon varying sized hands and for promoting heat transfer from the heating members 20 onto a user's fingers.

The pockets 14 of the heated glove 10 include loop material 40 (trademarked "Velcro") secured to opposing longitudinal portions 42 of the upper portions 16 of the finger members 18, and loop material 41 (trademarked "Velcro") secured to an inner lateral portion 44 of the upper portions 16 of the finger members 18. The pockets 14 further include a cover 46 having a first lateral portion 48 secured to an end portion 50 (via stitching 51 or similar securing elements) of each upper portion 16 of the finger members 18. The cover 46 has a second lateral portion 52 with hook material 54 secured to the second lateral portion 52 such that the hook material 54 ultimately engages the loop material 40 of the inner lateral portion 44 of an upper portion 16 of a corresponding finger member 18, thereby detachably securing the second lateral portion 52 of the pocket cover 46 to the inner lateral portion 44 of the upper portion 16 of the corresponding finger member 18.

The cover 46 further includes longitudinal portions 56 having hook material 58 secured to the longitudinal portions 56 such that the hook material 58 ultimately engages the loop material 40 of the longitudinal portions 42 of an upper portion 16 of a corresponding finger member 18, thereby detachably securing the longitudinal portions 56 of the cover 46 to the longitudinal portions 42 of the upper portion 16 of the corresponding finger member 18, resulting in the securing of the heating members 20 to the finger members 18.

The heated glove 10 are warmed by disposable heating members 20 fabricated from iron and additives that causes the iron to oxidize when exposed to air and produce heat. The heating members 20 are manufactured by "HeatPax" and "Hothands" both companies can be found on the internet. The heating members 20 are configured to snugly insert into the pockets 14 on the finger members 18. The heating members 20 extend longitudinally upon the upper portions 16 of the finger members 18 such that the longitudinal dimension of the heating members 20 are substantially the same as the longitudinal dimension of the respective finger member 18 to which the corresponding heating member 20 is secured.

The heating members 20 are disposed between the pocket covers 46 and the upper portions 16 of the finger members 18; whereupon, the pocket covers 46 are secured to the upper portions 16 of the finger member 18 via the longitudinal and lateral hook materials 54 land 58 engaging cooperating longitudinal and lateral loop materials 40 and 41, respectively, thereby securing the position of the heating members 20 relative to the corresponding finger member 18. The heating members 20 are flexible to allow the user to bend his or her fingers and grasp and hold an object. In the event that flexible heating members 20 are not available to heat the glove member 12, the heating members 20 can be comprised of two separated rigid sections having longitudinal dimensions corresponding to finger joints of the user, thereby allowing the user to bend his or her fingers to make a first to grasp and hold an object.

A relatively larger hand heating member 60 is configured (substantially square) to snugly insert into an upper hand portion 62 having a hand pocket 64 that includes a hand cover 65 secured to the upper hand portion 62 via the same loop 66 and hook 68 materials described above. The hand cover 65 is secured via stitching 70 proximate to the finger members 18 such that the hand pocket 64 covers substantially the entire surface area of the upper hand portion 62, thereby providing sufficient heating to warm the hand of the user The glove apertures 22 can be disposed in each finger member 18 to allow one or more fingers including the index finger 30 and the thumb 28 via the thumb aperture 23 to exit the glove 12 to enable the user to grasp and lift a relatively heavy object. Irrespective of the number of glove apertures 22 and 23 included in the glove 12, each aperture 22 and 23 is disposed proximate to a midportion of the finger members 18 and thumb member 26. The aperture 22 of the index finger member 24 is formed via an unsecured flexible overlap portion 72 or "flap" of a bottom portion 32 of the index finger member 24 engaging a non-flexible bottom surface 74 of the index finger member 24. The aperture 23 of the thumb member 26 is formed via an unsecured flexible overlap portion 73 of a bottom portion 76 of the thumb member 26 upon a non-flexible bottom surface 78 of the thumb member 26. The unsecured overlap portions 72 and 73 are relatively flexible to allow a user's thumb 28 and finger 30 to forcibly separate the overlap portions 72 and 73 from respective bottom surfaces 74 and 78 to enable the user to extend the thumb 28 and index finger 30 through respective apertures 22 and 23, thereby exposing the thumb 28 and index finger 30 to atmospheric conditions. When the user's finger and thumb are returned to a position inside the heated glove, the overlap portions 72 and 73 return to the same overlap configuration existing before the finger and thumb exited the glove 12.

The heated glove 10 further includes wrist flap 80 for adjustably securing the glove 12 about a user's wrist. The wrist flap 80 is adjusted by placing a flap edge portion 81 having a loop material (not depicted) secured to a bottom side of the edge portion 81 upon a user selected portion of cooperating hook material 82 secured to a top portion of a wrist portion 84 of the glove 12.

Figure 7:
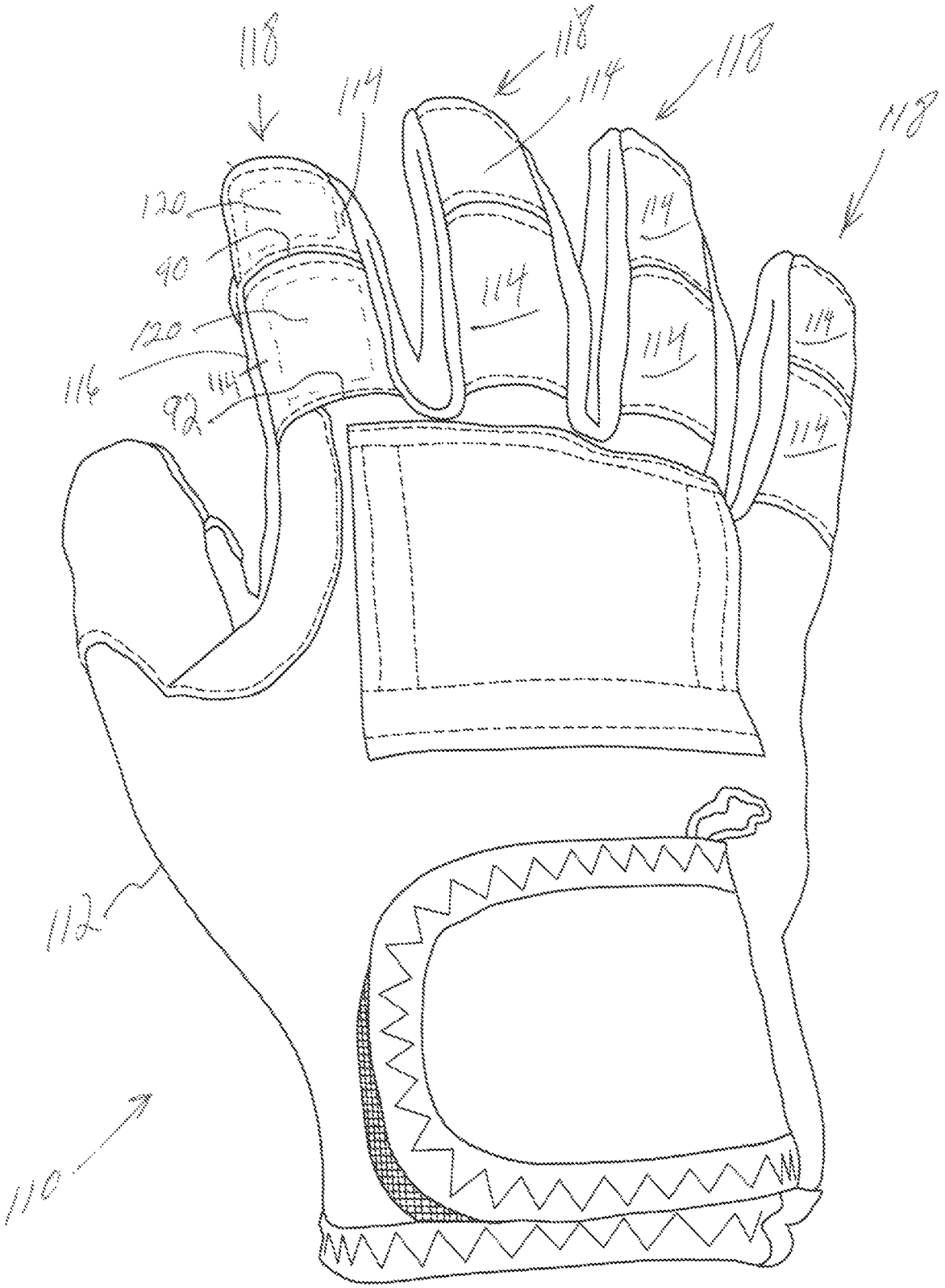
FIG. 7 is an alternative embodiment of the heated glove depicted in FIG. 1 in accordance with the present invention, the alternative embodiment illustrating two pockets replacing the finger cover portion of FIG. 2.
Figure 8:
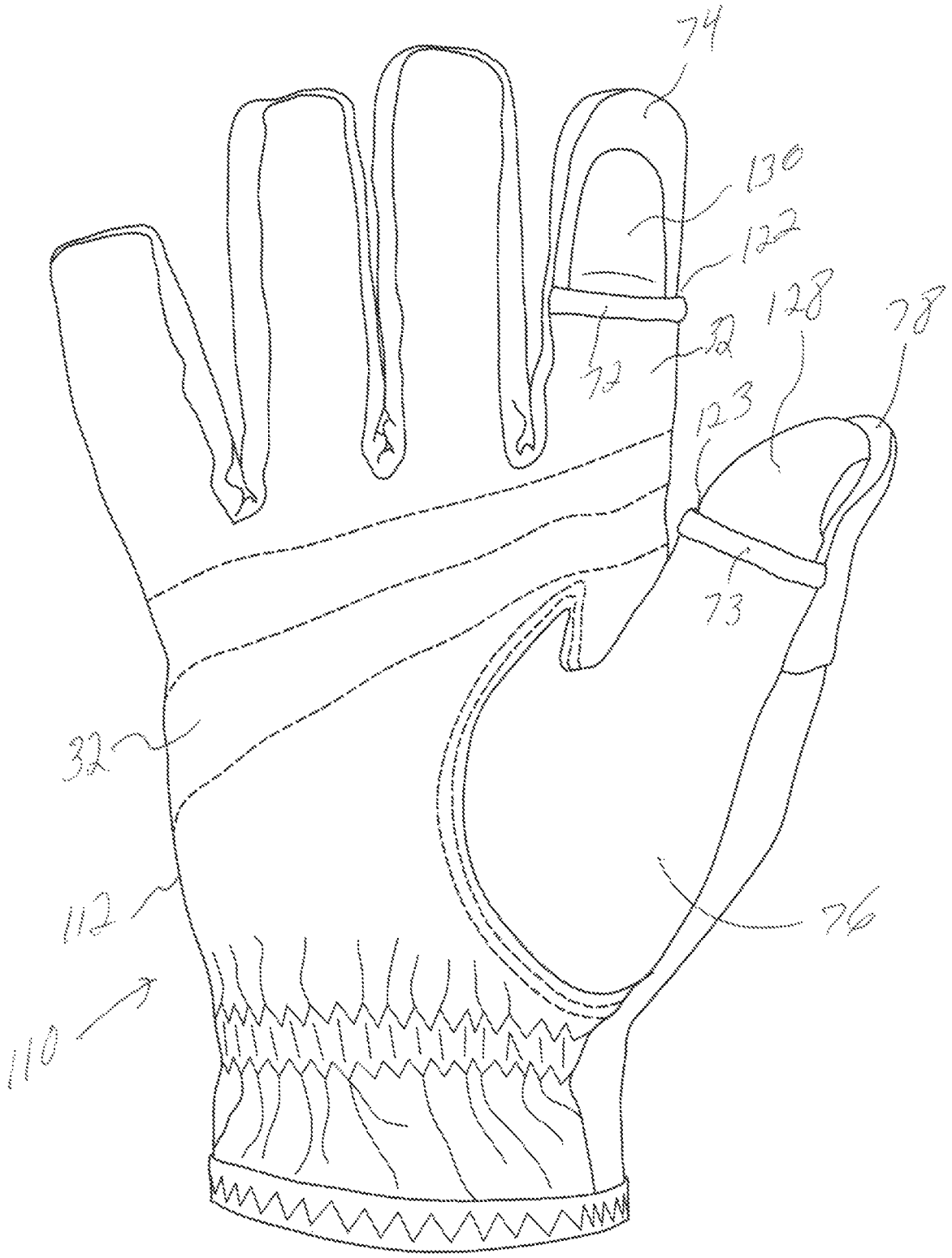
FIG. 8 is a bottom perspective view of the alternative embodiment of FIG. 7 illustrating the same finger and thumb, and finger and thumb members depicted in FIG. 6 in accordance with the present invention.

Referring to FIG. 7, an alternative heated glove having finger protrusion apertures in accordance with the present invention is denoted as numeral 110. The heated glove 110 includes substantially the same configuration and members as the heated glove 10. The difference between the two heated gloves 10 and 110 being that the heated glove 110 includes a glove 112 having two pockets 114 secured to and lineally aligned with an upper portion 116 of finger members 118 of the predetermined glove 112. Further, the alternative heated glove 110 does not include pocket covers and does not use loop and hook material to secure the pockets to an upper portion 116 of the finger members 118. The two pockets 114 removably receive cooperatively configured heating members 120 via apertures 90 and 92 (depicted in a closed position) by forcibly sliding the heating members through the apertures 90 and 92 and into each pocket 114. The alternative glove 112 includes index finger member aperture 122 and thumb aperture 123 having the same configurations and disposed in the same locations as the corresponding apertures 22 and 23 of the above described glove 12. The index finger aperture 122 and the thumb aperture 123 allow the index finger 130 and thumb 128 of a user protrude from the glove 112; whereby, the user is enabled to operate equipment or lift objects via the exposed finger 130 and thumb 128 when a heated glove 110 is worn on each hand of the user.

The foregoing description is for the purpose of illustration only and is not intended to limit the scope of protection accorded this invention. The scope of protection is to be measured by the following claims, which should be interpreted as broadly as the inventive contribution permits.

The invention claimed is:

1. A heated glove having finger protrusion apertures comprising: a glove member having predetermined dimensions and configuration, a plurality of finger members and a thumb member; at least one pocket comprising: an upper portion of at least one finger member having loop material secured to opposing longitudinal portions of said upper portion, said upper portion of said at least one finger member having loop material secured to an inner lateral portion of said upper portion of said at least one finger member, said loop material secured to said longitudinal portions being longitudinally dimensioned to extend from said inner lateral portion to a position distal to an end portion of said at least one finger member; and a cover having a first lateral portion integrally secured to said upper portion of said at least one finger member, said cover including a second lateral portion having hook material secured to said second lateral portion, whereby said hook material secured to said second lateral portion of said cover ultimately detachably engages said loop material secured to said inner lateral portion of said upper portion of said at least one finger member; said cover including longitudinal portions having hook material secured to each said longitudinal portions, said hook material being longitudinally dimensioned to extend from said hook material of said second lateral portion to a position distal to said end portion of said at least one finger member, whereby said hook material secured to said longitudinal portions of said cover ultimately detachably engages said loop material secured to said longitudinal portions of said upper portion of said at least one finger member, resulting in said cover being detachably secured upon said upper portion of said at least one finger member to form said at least one pocket, and said cover ultimately being separated from said upper portion, whereby said first lateral portion of said cover remains integrally secured to said upper portion of said at least one finger member, thereby maintaining a portion of said at least one pocket when a user separates said cover from said upper portion of said at least one finger member; a finger heating member removably disposed in each pocket secured to each finger member, said finger heating members each emitting a predetermined heat energy to warm an inner cavity in each finger member; and glove apertures disposed in an index finger member and said thumb member of said glove, said glove apertures adapted to removably receive a thumb and an index finger of a user; whereby, said glove apertures allow the thumb and finger of the user to protrude from said glove, thereby enabling the user to operate equipment via the protruding thumb and index finger, and to ultimately return the thumb and index finger inside the respective thumb member and index finger member.

2. The heated glove of claim 1 wherein said thumb member of said glove member includes a thumb pocket formed upon an outer portion of said thumb member, said thumb pocket removably receiving a heating member for said thumb member.

3. The heated glove of claim 1 wherein said glove member is manufactured from leather, latex, spandex, polyester, fleece, sheep leather, canvas, cotton, linen and combinations thereof.

4. The heated glove of claim 3 wherein said glove member includes leather forming a bottom portion of said glove, and leather and latex forming a top portion of said glove, thereby promoting the stretching of said top portion of said glove to allow said glove to be disposed upon varying sized hands and for promoting heat transfer from said heating members onto a user's fingers.

5. The heated glove of claim 1 wherein said finger heating member is removably disposed between said cover and said upper portion of said at least one finger member.

6. The heated glove of claim 5 wherein said maintained portion of said at least one pocket secured to said at least one finger member ultimately receives a corresponding portion of said finger heating member after said hook materials secured to said second lateral portion and said longitudinal portions of said cover are separated from cooperating loop materials secured to said inner lateral portion and said longitudinal portions of said upper portion of said at least one finger member.

7. The heated glove of claim 6 wherein said at least one finger member includes said index finger member.

8. The heated glove of claim 7 wherein said heating member is disposed between said cover and said upper portion of said index finger member; whereupon, said cover is secured to said upper portion of said index finger member via said longitudinal and lateral hook materials of said cover engaging cooperating longitudinal and lateral loop materials of said upper portion of said index finger member, thereby securing the position of said heating member relative to said index finger member.

9. The heated glove of claim 8 wherein said heating member extends longitudinally upon said upper portion of said finger member, said heating member including a configuration that promotes the insertion of said heating member into said pocket and the securing of said cover upon said upper portion of said finger member.

10. The heated glove of claim 8 wherein said heating member is flexible thereby allowing the user to bend his or her fingers and grasp and hold an object.

11. The heated glove of claim 8 wherein said heating member is comprised of two separated sections, thereby allowing the user to bend his or her fingers and grasp and hold an object.

12. The heated glove of claim 1 wherein said glove apertures are disposed in each finger member and said thumb member, thereby allowing multiple fingers and the thumb to protrude from said heated glove.

13. The heated glove of claim 12 wherein said glove apertures are disposed proximate to a midportion of said finger members.

14. The heated glove of claim 1 wherein said glove aperture of said index finger member is formed via an unsecured flexible overlap portion of a bottom portion of said index finger member upon a non-flexible bottom surface of said index finger member, thereby allowing the user's index finger to forcibly separate said overlap portion of said bottom portion of said index finger member from said bottom surface of said index finger member to enable the user to extend the index finger through the said glove aperture of said index finger member; said overlap portion of said index finger member returning to the original overlap configuration upon said bottom surface of said index finger member after the index finger is returned to a position inside said heated glove.

15. The heated glove of claim 1 wherein said glove aperture of said thumb member is formed via an unsecured flexible overlap portion of a bottom portion of said thumb member upon a non-flexible bottom surface of said thumb member, thereby allowing the user's thumb to forcibly separate said overlap portion of said bottom portion of said thumb member from said bottom surface of said thumb member to enable the user to extend the thumb through said glove aperture of said thumb member; said overlap portion of said thumb member returning to the original overlap configuration upon said bottom surface of said thumb member after the thumb is returned to a position inside said heated glove.

16. The heated glove of claim 1 wherein said glove member includes an upper hand portion having a hand pocket secured thereto that removably receives a heating member having a configuration that cooperates with the configuration of said hand pocket.

17. A heated glove comprising: a glove member having predetermined dimensions and configuration, a plurality of finger members and a thumb member; at least one pocket comprising: an upper portion of at least one finger member having loop material secured to opposing longitudinal portions of said upper portion, said upper portion of said at least one finger member having loop material secured to an inner lateral portion of said upper portion of said at least one finger member, said loop material secured to said longitudinal portions being longitudinally dimensioned to extend from said inner lateral portion to a position distal to an end portion of said at least one finger member; and a cover having a first lateral portion integrally secured to said upper portion of said at least one finger member, said cover including a second lateral portion having hook material secured to said second lateral portion, whereby said hook material secured to said second lateral portion of said cover ultimately detachably engages said loop material secured to said inner lateral portion of said upper portion of said at least one finger member; said cover including longitudinal portions having hook material secured to each said longitudinal portions, said hook material being longitudinally dimensioned to extend from said hook material of said second lateral portion to a position distal to said end portion of said at least one finger member, whereby said hook material secured to said longitudinal portions of said cover ultimately detachably engage said loop material secured to said longitudinal portions of said upper portion of said at least one finger member, resulting in said cover being detachably secured upon said upper portion of said at least one finger member to form said at least one pocket, and said cover ultimately being separated from said upper portion, whereby said first lateral portion of said cover remains integrally secured to said upper portion of said at least one finger member, thereby maintaining a portion of said at least one pocket; and a heating member removably disposed in each pocket of each finger member and said thumb member, said finger heating members each emitting a predetermined heat energy to warm an inner cavity in each finger member.

18. The heated glove of claim 17 wherein said finger heating member is removably disposed between said cover and said upper portion of at least one finger member.

19. The heated glove of claim 18 wherein said maintained portion of said at least one pocket secured to said at least one finger member ultimately receives a corresponding portion of said finger heating member after said hook materials secured to said second lateral portion and said longitudinal portions of said cover are separated from cooperating loop materials secured to said inner lateral portion and said longitudinal portions of said upper portion of said at least one finger member.

20. A heated glove comprising: a glove member having predetermined dimensions and configuration, a plurality of finger members and a thumb member; an upper portion of an index finger member having loop material secured to opposing longitudinal portions of said upper portion, said upper portion of said index finger member having loop material secured to an inner lateral portion of said upper portion of said index finger member, said loop material secured to said longitudinal portions being longitudinally dimensioned to extend from said inner lateral portion to a position distal to an end portion of said index finger member; and a cover having a first lateral portion integrally secured to said upper portion of said index finger member, said cover including a second lateral portion having hook material secured to said second lateral portion, whereby said hook material secured to said second lateral portion of said cover ultimately detachably engages said loop material secured to said inner lateral portion of said upper portion of said index finger member; said cover including longitudinal portions having hook material secured to each said longitudinal portions, said hook material being longitudinally dimensioned to extend from said hook material of said second lateral portion to a position distal to said end portion of said index finger member, whereby said hook material secured to said longitudinal portions of said cover ultimately detachably engage said loop material secured to said longitudinal portions of said upper portion of said index finger member, resulting in said cover being detachably secured upon said upper portion of said index finger member to form said at least one pocket, and said cover ultimately being separated from said upper portion, whereby said first lateral portion of said cover remains integrally secured to said upper portion of said index finger member, thereby maintaining a portion of said at least one pocket for receiving a portion of a heating member removably disposed in said at least one pocket, said heating member emitting a predetermined heat energy to warm an inner cavity in said index finger member.

* * * * *